US005209151A

United States Patent [19]

Takagi et al.

[11] Patent Number: 5,209,151

[45] Date of Patent: May 11, 1993

[54] TAPE CUTTER

[75] Inventors: Yukihito Takagi, Kasugai; Shigeru Nakata; Takashi Miki, both of Nagoya, all of Japan

[73] Assignee: Brother Kogyo Kabushiki Kaisha, Nagoya, Japan

[21] Appl. No.: 792,412

[22] Filed: Nov. 15, 1991

[30] Foreign Application Priority Data

Dec. 6, 1990 [JP] Japan ..... 2-400146[U]

[51] Int. Cl.[5] ..... B41J 3/38; B65H 35/06

[52] U.S. Cl. ..... 83/564; 83/584; 83/589; 83/644; 400/621

[58] Field of Search ..... 400/621, 134.5, 134.6; 83/582, 584, 589, 338, 564, 642, 647, 649, 922, 644, 611

[56] References Cited

U.S. PATENT DOCUMENTS

| | | | |
|---|---|---|---|
| 1,767,942 | 6/1930 | Rugen | 83/589 |
| 2,051,453 | 8/1936 | Mactaggart et al. | 83/338 |
| 3,083,807 | 4/1963 | Travaglio | 83/611 X |
| 3,389,772 | 6/1968 | Sjogren et al. | 400/621 X |
| 4,527,455 | 7/1985 | Morax | 83/582 X |
| 4,983,058 | 1/1991 | Nagae | 400/249 |
| 4,984,491 | 1/1991 | Bragaglia | 83/642 X |

FOREIGN PATENT DOCUMENTS

| | | |
|---|---|---|
| 0313127 | 4/1989 | European Pat. Off. . |
| 0322918 | 7/1989 | European Pat. Off. . |
| 0327076 | 8/1989 | European Pat. Off. . |
| 3823335A1 | 3/1990 | Fed. Rep. of Germany . |
| 47-16105 | 5/1972 | Japan . |

*Primary Examiner*—Eugenia Jones
*Attorney, Agent, or Firm*—Oliff & Berridge

[57] ABSTRACT

In a tape cutter capable of cutting a tape completely and enhancing the durability of the cutter blade, a cutter holder is rotated by the engagement of a holder gear portion with a lever gear portion according to the rotation of an operation lever so that a cutter blade is moved toward a tape face. A sliding projection slides upwardly along an inclined face and the cutter holder is moved in the widthwise direction of the tape T. Therefore the cutter blade 13 presses the tape face and cuts the tape T while sliding in the widthwise direction of the tape T.

11 Claims, 5 Drawing Sheets

TAPE CUTTER

BACKGROUND OF THE INVENTION

1. Field of the Invention

The invention relates to a tape cutter and, more particularly, to a tape cutter having a slidable cutter blade employed in a tape printer where characters such as letters and symbols are printed or impressed on a tape.

2. Description of Related Art

There have been known tape printers for printing or inscribing characters such as letters and symbols on a tape in order to produce display labels and the like. One example is disclosed in Japanese Patent Publication No. 47-16105. In this type of tape printer, a desired character is selected by rotating a dial and the selected character is printed or impressed on a tape. The tape is fed and cut to a predetermined length by a cutter blade. In a tape cutter employed in this type of tape printer, the cutter blade is moved toward a tape face and a cutting edge is pressed against the tape face. Namely, the cutter blade is pressed perpendicularly to the tape face so that the cutting edge is dug into the tape, by a pressure force, to cut the tape.

In this tape cutter, however, the tape cannot be cut unless a large pressure force is applied by the cutter blade to the tape face. Accordingly, the cutter blade is operated in such a manner as to cut the tape under great pressure, with an attendant problem of the generation of nicks in the cutter blade which deteriorates the durability of the cutter blade.

If the cutting edge of the cutter blade does not have a uniform cutting capacity, the tape may not be cut where the cutting edge is damaged (e.g., a portion having nicks). Consequently, the tape cannot be completely cut off.

SUMMARY OF THE INVENTION

An object of the invention is to provide a tape cutter capable of cutting the tape completely. Another object of the present invention is to enhance the durability of a cutter blade.

A tape cutter according to the invention is employed in a tape printer having a printer unit wherein characters such as letters and symbols are printed or impressed on a tape. The tape cutter comprises a tape feeding mechanism for feeding the tape in a predetermined direction, a cutter blade for cutting the tape, a pressing mechanism for moving the cutter blade toward a tape face so as to press the cutting edge of the cutter blade against the tape face, and a slide mechanism for moving the cutter blade in the direction of formation of the cutter blade when the cutter blade is moved toward the tape face.

In the tape cutter thus structured, the pressing mechanism moves the cutter blade toward the tape face to press the cutting edge against the tape face. In this state, the slide mechanism moves the cutter blade in the direction of formation of the cutter blade (in the direction of the tape width). Namely, the cutter blade is slid in the direction of formation of the cutter blade while pressing the tape face. As a result, the cutter blade slides even if the pressure force of the cutting edge which is dug into the tape is small to thereby cut the tape completely.

According to the tape cutter of the present invention, the cutter blade is slid in the direction of formation of the cutter blade while pressing the tape face so that the tape can be cut completely by a small pressure force.

Furthermore, the durability of the cutter blade is enhanced because it is unnecessary to apply any great pressure force to the cutter blade.

BRIEF DESCRIPTION OF THE DRAWINGS

The invention will be described with references to the drawings in which.

DETAILED DESCRIPTION OF THE PREFERRED EMBODIMENTS

The structure and function of a tape cutter which embodies the invention will be explained with reference to the drawings.

Figure 1A:
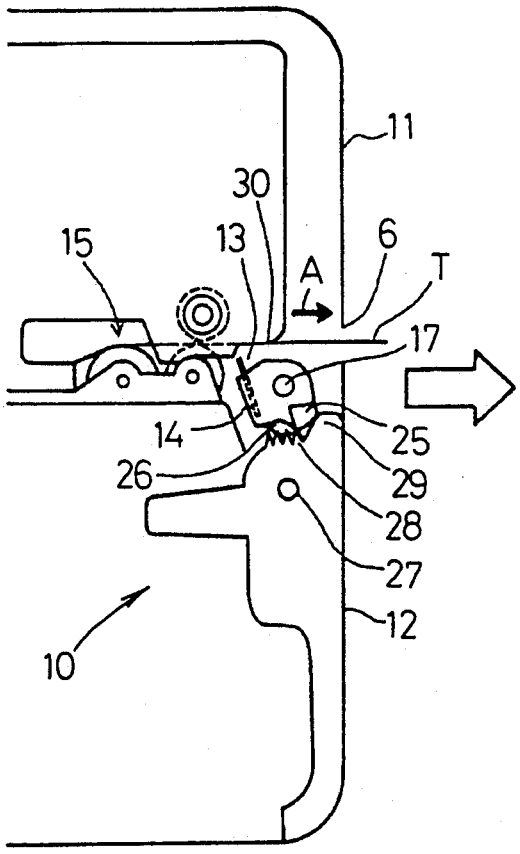
FIG. 1A is a bottom view of a tape cutter before cutting a tape.
Figure 1B:
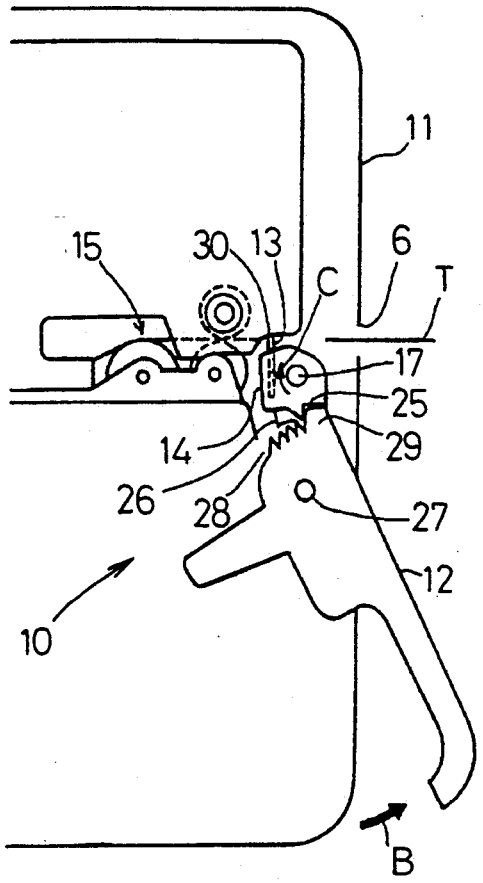
FIG. 1B is a bottom view of the tape cutter after cutting the tape.
Figure 2:
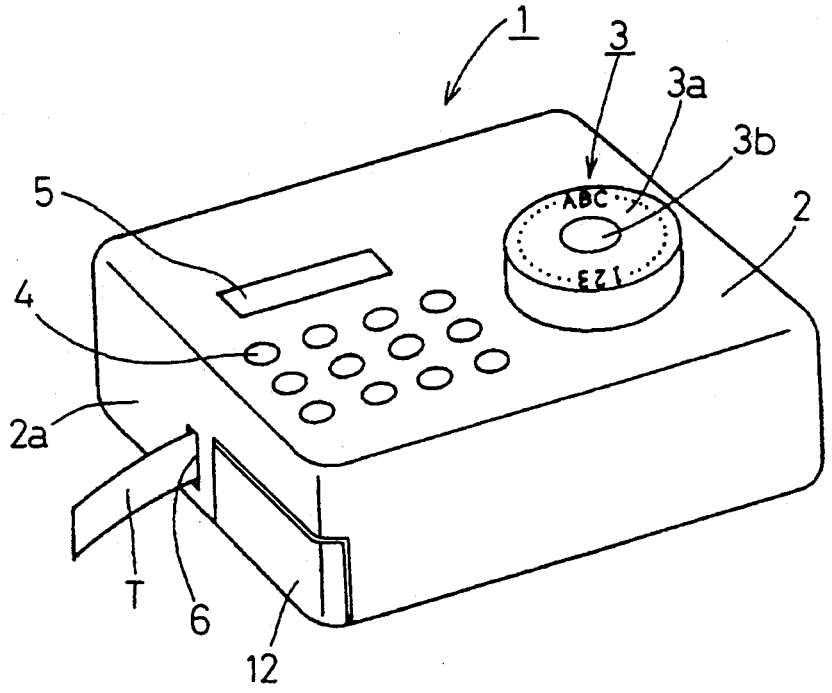
FIG. 2 is a perspective view of a tape printer with the tape cutter disposed therein.

As shown in FIGS. 1A-2, a tape printer 1 has a rectangular housing 2 having rounded corners. A rotatable cylindrical character selection dial 3 is mounted on the top side of the housing 2. Characters such as letters and symbols are impressed on the dial face 3*a* of the character selection dial 3 and an operator rotates the character selection dial 3 to select a desired character. In the center of the character selection dial 3 is formed a decision key 3*b*, by which the character selected by the character selection dial 3 is entered. On the top side of the housing 2, in addition to the character selection dial 3, are mounted a group of function keys 4, for performing various settings necessary for tape printing, and a liquid crystal display 5 for displaying the character set by the group of function keys 4. Upon operation of a print key, one of the function keys 4, the entered character is printed on a tape T in a printer unit (not shown), and then, the tape T is discharged out of the housing 2 to the exterior through a tape outlet 6.

Figure 3A:
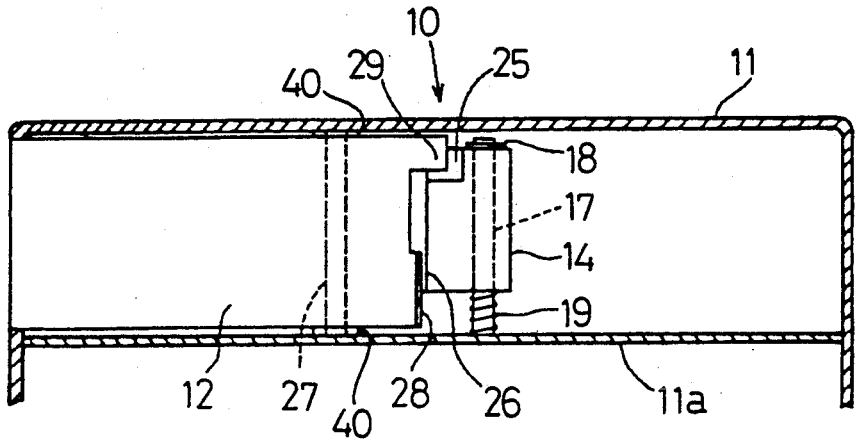
FIG. 3A is a right elevational view of the tape cutter as shown in FIG. 1A.
Figure 3B:
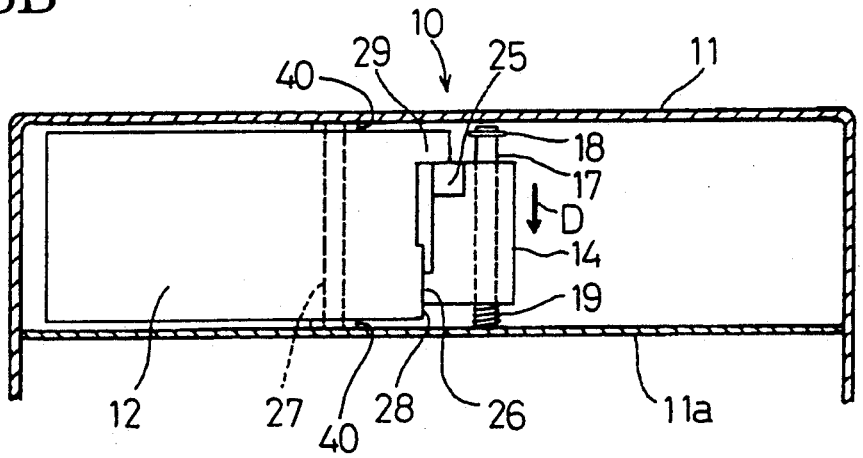
FIG. 3B is a right elevational view of the tape cutter as shown in FIG. 1B.

Next, a tape cutter 10 for cutting the tape T, after it has been printed and discharged to the exterior in the above described manner, will be described The tape cutter 10 is housed inside the side face 2*a* of the housing 2. As illustrated in FIGS. 1A and 1B, a part of the housing 2 serves as the main unit 11 of the tape cutter 10. FIGS. 1A and 1B show the tape cutter 10, as viewed from the bottom in FIG. 2, with FIG. 1A depicting a state before the tape is cut and FIG. 1B depicting a state at the time of cutting the tape. Portions not involved in the tape cutting operation are omitted. FIGS. 3A and 3B show the principal component parts of the tape cutter 10 as viewed from the right in FIGS. 1A and 1B.

As shown in FIGS. 1A, 1B and 3A, 3B, the tape cutter 10 comprises an operation lever 12 for use by the operator in performing the tape cutting operation and a cutter holder 14, having a cutter blade 13, and capable of being rotated and slid (described later) by the operation of the operation lever 12.

Figure 4:
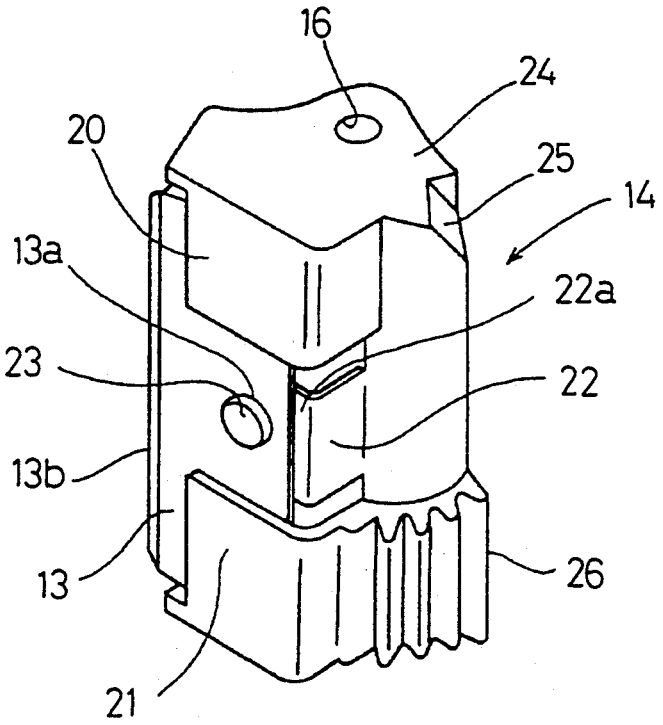
FIG. 4 is a perspective view of a cutter holder.

The cutter holder 14 is disposed in the vicinity of a feed passage of the tape T between a tape feed mechanism 15 and the tape outlet 6. As illustrated in FIG. 4, the cutter holder 14 is integrally made of synthetic resin (e.g., polyacetal and nylon) in a column shape and is provided with an annular hole 16 bored in the axial direction thereof. As depicted in FIG. 3, the cutter holder 14 is rotatably supported on a pin 17 erected on the bottom plate 11*a* of the main unit 11 of the tape cutter 10, with the pin 17 loosely inserted into the annular hole 16. At the tip end of the pin 17 is fitted a snap ring 18 having a diameter larger than that of the annular hole 16. The cutter holder 14 can therefore slide between the snap ring 18 and the bottom plate 11*a*. A coil spring 19 is wound around the pin 17 on the bottom plate 11*a* side, that is, between the cutter holder 14 and the bottom plate 11*a*, to urge the cutter holder 14 toward the snap ring 18.

As illustrated in FIG. 4, the cutter holder 14 is provided with two cutter holding plates 20, 21 each formed into an almost L shape at both ends thereof in the axial direction, and a cutter pressing plate 22 having a substantially L shape located between the two cutter holding plates 20, 21. A columnar projection 23 projects from a pressing face 22*a* serving as the loose end of the cutter pressing plate 22. The cutter blade 13 is interposed between the two cutter holding plates 20, 21 and the cutter pressing plate 22 and, further, the projection 23 of the cutter pressing plate 22 is inserted into an annular hole 13*a* bored in the cutter blade 13 so that the cutter blade 13 is held in position. The cutter pressing plate 22 is resiliently deformed inwardly, by pressing the projection 23 inward at the time of the insertion of the cutter blade 13, and is brought into close contact with the cutter blade 13, by its restoring force upon insertion of the projection 23 into the annular hole 13*a* of the cutter blade 13, to thereby press the cutter blade 13 against the faces of the cutter holding plates 20, 21. Accordingly, the cutter blade 13 is securely disposed in a predetermined position parallel to the pin 17 with the cutting edge 13*b* thereof facing outward. In case of exchange of the cutter blade 13, the projection 23 is pressed inward so that the cutter blade 13 can be easily removed.

At the upper face 24 of the cutter holder 14, on the side opposite to the cutting edge 13*b*, an inclined face 25 is formed of a notch cut off slantwise with respect to the upper face 24. Under the inclined face 25 of the cutter holder 14 is formed a holder gear portion 26, which is meshed with the lever gear portion 28 of the operation lever 12, described later, for transmission of the operation of the operation lever 12 to the cutter holder 14.

The operation lever 12 is made of synthetic resin into a substantially L-shaped form, as shown in FIGS. 1A, 1B and 3A, 3B, and rotatably supported on a shaft 27 fixed in the main body 11. A washer 40 is positioned between the operation lever 12 and both the main body 11 and bottom plate 11*a* to prevent the operation lever 12 from The lever gear portion 28, meshed with the holder gear portion 26, is disposed opposite to the holder gear portion 26 of the cutter holder 14. Furthermore, a roundish sliding projection 29 projects faced to the inclined face 25 formed in the cutter holder 14. The sliding projection 29 is positioned in abutment against the lower end of the inclined face 25 when the tape T is not cut, as illustrated in FIGS. 1A and 3A. The operation lever 12 rotates on the shaft 27 with projection 29 riding over inclined face 25 to force cutter holder 14 axially along pin 17, as shown by arrow D of FIG. 3B.

Next, the operation of the tape cutter 10 will be explained.

When the desired character is printed on the tape T by the printer unit (not shown), the tape T is fed in the direction indicated by an arrow A by the tape feed mechanism 15, as shown in FIG. 1A, and comes to a halt in a predetermined position. In order to cut the tape T, the operation lever 12 is pulled by the operator in the direction indicated by an arrow B. Consequently, the operation lever 12 pivots around the shaft 27 so that the cutter holder 14 is rotated around the pin 17 in the direction indicated by an arrow C by the engagement of the holder gear portion 26 with the lever gear portion 28. At the same time, the sliding projection 29 abutting against the lower end of the inclined face 25 of the cutter holder 14, slides over the inclined face 25 as the operation lever 12 is rotated in the direction indicated by the arrow B. Although the cutter holder 14 is normally urged upwardly (i.e., in the direction of the snap ring 18) by the coil spring 19, the cutter holder 14 is pressed in the downward direction indicated by an arrow D, shown in FIG. 3B, against the urging of the coil spring 19 by the rotation of the sliding of projection 29 over inclined face 25 of the cutter holder 14, since the vertical movement of the sliding projection 29 is substantially prohibited by washers 40. As a result, the cutter holder 14 rotates around the pin 17 and moves in the axial direction (i.e., the direction indicated by the arrow D).

The cutter blade 13 disposed in the cutter holder 14 is moved toward the tape face by the series of operations described above and, at the same time, it is moved in the axial direction, that is, in the direction of formation of the cutter blade 13. When the operation lever 12 continues to be pulled in the direction indicated by the arrow B after the cutter blade 13 reaches the tape face, the tape T is sandwiched between the cutter blade 13 and the cutter blade receiving portion 30. In this state, a force perpendicular to the tape face and a force in the direction of the formation of the cutter blade 13 (in the direction of the tape width) are acted onto the cutter blade 13, so that the tape T can be easily cut. Namely, because the tape face is both pressed by the cutter blade 13 and the cutter blade 13 slides in the direction of the tape width, the tape T is cut with ease. In this stage, the sliding projection 29 reaches the upper face 24 of the cutter holder 14 as illustrated in FIG. 3B.

Figure 5:
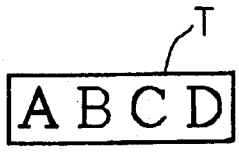
FIG. 5 is a front view of a cut tape.
Figure 6:
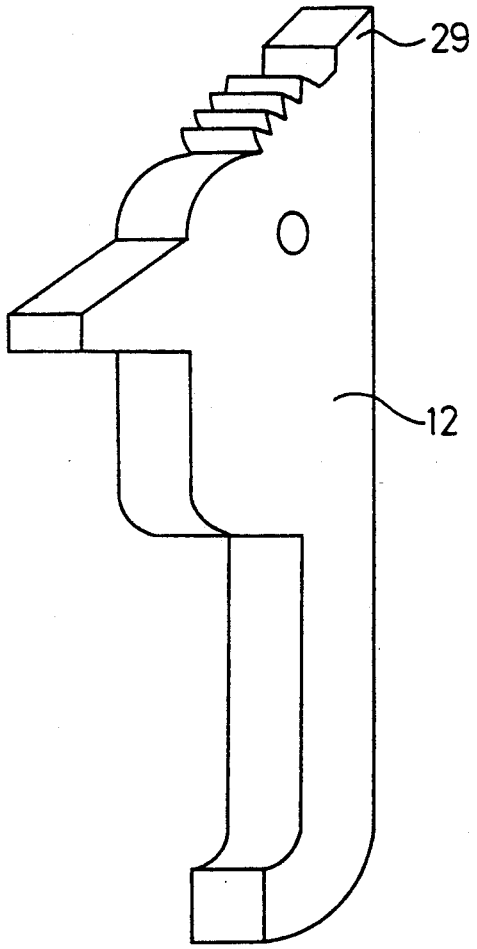
FIG. 6 is a perspective view of an operation lever.

When the tape T is cut and the operator releases the operation lever 12, the operation lever 12 is turned clockwise, as shown in FIG. 1B, by a spring (not shown), and returned to the state depicted in FIG. 1A. The cutter holder 14 slides upwardly along the pin 17 at the urge of the coil spring 19, to be returned to the state illustrated in FIG. 3A. Accordingly, the tape T, cut in a predetermined length, is obtained as shown in FIG. 5. The tape T is cut with a given blank portion formed between the printed character and the cut edge.

In the tape cutter in this embodiment, as is apparent from the above description, the inclined face 25 abutting against the sliding projection 29 is formed in the cutter holder 14 and the sliding projection 29 slides along the inclined face 25 during the turning of the operation lever 12 so that the cutter blade 13 slides in the direction of the formation of the cutter blade 13 (in the direction of the tape width). Consequently, the tape T can be easily cut by the pressure and sliding movement of the cutter blade 13. Therefore, the tape T can be cut much more easily in comparison with the conventional cutters where the tape face is simply pressed by the cutter blade.

Moreover, it is unnecessary to apply a great pressing force to the cutter blade 13, thereby enhancing the durability (lifetime) of the cutter blade 13. In addition, the sliding movement of the cutting blade 13 can compensate for defects in the cutting edge 13*b* of the cutter blade 13 such as it does not have a uniform cutting capacity due to nicks or the like. Thus, the invention prevents the possibility of an uncut part in the tape T that is found in the conventional cutters. Further, in conventional cutters, the cut face may be deformed if the tape T is cut by the great pressing force. In the tape cutter 10 in this embodiment, however, the cut face can be neatly finished with a reduced pressing force that does not deform the cut face.

Although the invention has been described in its preferred form, the present invention is not limited in its practical application to the foregoing specific embodiment. For example, the invention is applicable to a tape cutter wherein the cutter blade is electrically operated by a motor or the like so as to cut the tape T. Many changes and modifications can be made without departing from the spirit or scope of the invention. Although the sliding projection 29 is disposed on the operation lever 12 side and the inclined face 25 is formed on the cutter holder 14 side in this embodiment, the inclined face may be formed on the operation lever side while the sliding projection may be disposed on the cutter holder side, or inclined faces may be formed on both sides. Furthermore, a variation in shape of the inclined face can change the ratio of the movement of the cutter blade with respect to the tape face and the resultant sliding movement of the cutter blade. Thus, the ratio of movement may be set suitable for the thickness, strength and the like of a tape.

What is claimed is:

1. A tape cutter, comprising:

a tape feeding mechanism for feeding a tape on which characters from a group including letters, numbers and symbols are printed or impressed in a predetermined direction;

a slidable cutter blade holding member rotatably mounted to a first shaft fixed in a main body of the tape cutter;

a cutter blade mounted in said cutter blade holding member for cutting the tape;

a pressing mechanism rotatably mounted around a second shaft in said main body for moving said cutter blade toward a tape face so as to press a cutting edge of the cutter blade against the tape face; and a slide mechanism for moving the cutter blade in a direction of the tape width when the cutter blade is moved toward blade holding member which has a notch portion cut off slantwise with respect to an upper face of said cutter blade holding member and said pressing mechanism has a projection which engages the notch portion.

2. A tape cutter having a slidable cutter blade, comprising:

a tape feeding mechanism for feeding a tape on which characters from a group including letters, numbers and symbols are printed or impressed in a predetermined direction;

an operating member rotatably disposed around a first shaft fixed in a main body; and a cutter blade holding member for engaging with said operating member and holding a cutter blade, said cutter blade holding member is rotatably supported around a second shaft fixed in the main body and is slidably moved in the direction of the tape width by the rotation of said operating member, and wherein said cutter blade holding member has a frame for fixing the second shaft thereon, the second shaft has a snap ring for restricting the movement in the axial direction of said second shaft by said cutter blade on one end thereof and has a spring at the other end thereof between the main body and said cutter blade holding member.

3. A tape cutter according to claim 2, wherein said cutter blade holding member has a notch portion cut off slantwise with respect to an upper face and said operating member has a projection which engages with the notch portion.

4. A tape cutter according to claim 2, wherein said operating member has an operation gear portion and said cutter blade holding member has a holder gear portion meshed with the operation gear portion.

5. The tape cutter as claimed in claim 2, further comprising a pair of washers, one washer of said pair of washers seated on said first shaft on each side of said operating member.

6. A tape cutter mounted in a housing, comprising:

a lever pivotally mounted to a first projection extending from the housing;

a cutter holder pivotally and axially slidably mounted to a second projection extending from the housing, an axis of said first projection and an axis of said second projection being parallel;

retention means at an end of said second projection for retaining said cutter holder on said second projection;

tension means for forcing said cutter holder against said retention means;

a cutter blade mounted in said cutter holder; and a cutter blade receiving portion against and over which said cutter blade may be pressed and slid, wherein said lever and said cutter holder engage one another.

7. The tape cutter as claimed in claim 6, further comprising sliding means for pushing said cutter holder to slide along said second projection away from said retention means.

8. The tape cutter as claimed in claim 7, wherein said sliding means comprises a notch having an inclined surface formed in a first end of said cutter holder and a sliding projection extending from said lever for engaging said inclined surface.

9. The tape cutter as claimed in claim 8, wherein a second end of said cutter holder has gear teeth that engage gear teeth on said lever.

10. The tape cutter as claimed in claim 6, wherein said tension means comprises a coil spring mounted around said second projection between said blade holder and the housing.

11. The tape cutter as claimed in claim 6, further comprising a pair of washers, one washer of said pair of washers seated on said first projection on each side of said lever.

* * * * *